US010510277B2

(12) United States Patent
Wang

(10) Patent No.: US 10,510,277 B2
(45) Date of Patent: Dec. 17, 2019

(54) ORGANIC LIGHT EMITTING DISPLAY DEVICE AND REPAIRING METHOD THEREOF

(71) Applicant: Samsung Display Co., Ltd., Yongin-si (KR)

(72) Inventor: In Soo Wang, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 13 days.

(21) Appl. No.: 15/159,688

(22) Filed: May 19, 2016

(65) Prior Publication Data

US 2017/0032722 A1 Feb. 2, 2017

(30) Foreign Application Priority Data

Jul. 28, 2015 (KR) ..... 10-2015-0106642

(51) Int. Cl.

| | |
|---|---|
| ***G09G 3/00*** | (2006.01) |
| ***G09G 3/3266*** | (2016.01) |
| ***G09G 3/3233*** | (2016.01) |
| ***G09G 3/3275*** | (2016.01) |

(52) U.S. Cl.

CPC ..... *G09G 3/006* (2013.01); *G09G 3/3233* (2013.01); *G09G 3/3266* (2013.01); *G09G 3/3275* (2013.01); *G09G 2310/0289* (2013.01); *G09G 2330/08* (2013.01); *G09G 2330/10* (2013.01); *G09G 2330/12* (2013.01)

(58) Field of Classification Search

CPC .... G09G 3/006; G09G 3/3233; G09G 3/3266; G09G 3/3275; G09G 2310/0289; G09G 2330/08; G09G 2330/10; G09G 2330/12

See application file for complete search history.

(56) References Cited

U.S. PATENT DOCUMENTS

| | | | | |
|---|---|---|---|---|
| 2004/0232939 | A1* | 11/2004 | Toro-Lira | G09G 3/006 324/760.02 |
| 2014/0329339 | A1* | 11/2014 | Chaji | G01R 31/26 438/10 |
| 2014/0340432 | A1* | 11/2014 | Chaji | G09G 3/3233 345/690 |
| 2014/0354622 | A1 | 12/2014 | Qin et al. | |
| 2016/0027381 | A1* | 1/2016 | Ryu | G09G 3/3233 345/76 |

* cited by examiner

*Primary Examiner* — Wing H Chow

(74) *Attorney, Agent, or Firm* — Lewis Roca Rothgerber Christie LLP

(57) ABSTRACT

An organic light emitting display device including pixels positioned in regions defined by scan lines and light emission control lines extending in a first direction, and data lines extending in a second direction different from the first direction, the pixels being configured to control an amount of current flowing from a first power source to a second power source by way of organic light emitting diodes (OLEDs) in response to data signals, organic light emitting display device includes a scan driver configured to sequentially supply scan signals to the scan lines and light emission control signals to the light emission control lines during an inspection period, and a data driver configured to supply inspection data signals to the data lines in synchronization with the scan signals during the inspection period.

9 Claims, 8 Drawing Sheets

ORGANIC LIGHT EMITTING DISPLAY DEVICE AND REPAIRING METHOD THEREOF

CROSS-REFERENCE TO RELATED APPLICATION

This application claims priority to and the benefit of Korean Patent Application No. 10-2015-0106642, filed on Jul. 28, 2015, in the Korean Intellectual Property Office, the entire contents of which are incorporated herein by reference.

BACKGROUND

1. Field

Embodiments of the present invention relate to an organic light emitting display device and a repairing method thereof, and more particularly, to an organic light emitting display device and a repairing method thereof capable of detecting and repairing a defective pixel.

2. Description of the Related Art

As information technology has developed, the importance of display devices as connection mediums between users and information has increased. In line with this, the use of display devices such as liquid crystal display devices or organic light emitting display devices has increased.

An organic light emitting display device includes pixels positioned in regions defined by scan lines and data lines, a scan driver for driving the scan lines and a data driver for driving the data lines.

The scan driver supplies a scan signal to the scan lines, and accordingly, pixels are selected by horizontal lines. The data driver supplies data signals in synchronization with the scan signals. The data signals are supplied to pixels selected by the scan signals. Upon receiving the data signals, the pixels generate light having a brightness (e.g., a predetermined brightness) by controlling an amount of current flowing from a first power source to a second power source through an organic light emitting diode (OLED). In addition, a light emission time of the pixels is controlled by a light emission control signal supplied from a light emission control line.

A defective pixel in the organic light emitting device is repaired through an inspection process and a repairing process. However, in the related art inspecting process, it is difficult to detect a short between the first power source and the light emission control line using signal waves.

Thus, a short between the first power source and the light emission control line is detected using a camera. However, inspecting every pixel included in a panel using a camera increases inspection time. In particular, in case of large high resolution panels, an increase in time due to the camera inspecting process may decrease production yield.

SUMMARY

Embodiments of the present invention relate to an organic light emitting display device and a repairing method thereof capable of detecting and repairing a defective pixel.

An organic light emitting display device including pixels positioned in regions defined by scan lines and light emission control lines extending in a first direction and data lines extending in a second direction different from the first direction, the pixels being configured to control an amount of current flowing from a first power source to a second power source by way of organic light emitting diodes (OLEDs) in response to data signals, the organic light emitting display device according to an embodiment of the present invention includes: a scan driver configured to sequentially supply scan signals to the scan lines and light emission control signals to the light emission control lines during an inspection period; a data driver configured to supply inspection data signals to the data lines in synchronization with the scan signals during the inspection period; a first power source supply configured to supply a first voltage as the first power source during the inspection period and to supply a second voltage as the first power source during an other suitable period, the second voltage being higher than the first voltage; and one or more pads connected to at least one of the data lines.

A short between a specific one of the light emission control lines and the first power source may be detected using an amount of current applied to the one or more pads during the inspection period.

The first voltage of the first power source may be set to a voltage lower than that of the inspection data signal, and the second voltage may be set to a voltage at which the pixels may emit light.

A method of repairing an organic light emitting display device according to an embodiment of the present invention includes: supplying scan signals to scan lines and light emission control signals to light emission control signals, line by line; supplying inspection data signals to data lines in synchronization with the scan signals; detecting a defect, line by line, according to an amount of current supplied to at least one pad connected to the data lines to determine that an i-th line (i is a natural number) is defective; inspecting a short between an i-th one of the light emission control lines and a first power source, the first power source supplying a current in each of pixels positioned in the i-th line; and repairing one or more of the pixels that are determined to be shorted.

The inspection data signals may be supplied from a data driver.

The at least one pad may be connected to each of the data lines, and the inspection data signals may be supplied from a probe connected to the at least one pad.

In the inspecting the short, the short between the first power source and the i-th one of light emission control lines, in the one or more of the pixels that are determined to be shorted, may be detected using a camera.

In the repairing of the one or more of the pixels that are determined to be shorted, the i-th one of the light emission control lines and the first power source may be electrically isolated using a laser in the one or more of the pixels that are determined to be shorted.

The first power source may be set to have a voltage value lower than that of the inspection data signal.

According to the organic light emitting display device and the repairing method thereof of the present invention, a short between the first power source and the light emission control line may be inspected line by line using signal waves during an inspection period. Thus, a repairing process using a camera may be performed only in a line in which a defect has occurred, and thus, an inspection period may be shortened.

BRIEF DESCRIPTION OF THE DRAWINGS

Example embodiments will be described more fully hereinafter with reference to the accompanying drawings; however, they may be embodied in different forms and should not be construed as limited to the embodiments set forth herein. Rather, these embodiments are provided so that this disclosure will be thorough and complete, and will full convey the scope of the example embodiments to those skilled in the art.

In the figures, dimensions may be exaggerated for clarity of illustration. Further, it will also be understood that when one element, component, region, layer and/or section is referred to as being "between" two elements, components, regions, layers, and/or sections, it can be the only element, component, region, layer and/or section between the two elements, components, regions, layers, and/or sections, or one or more intervening elements, components, regions, layers, and/or sections may also be present.

DETAILED DESCRIPTION

Figure 1:
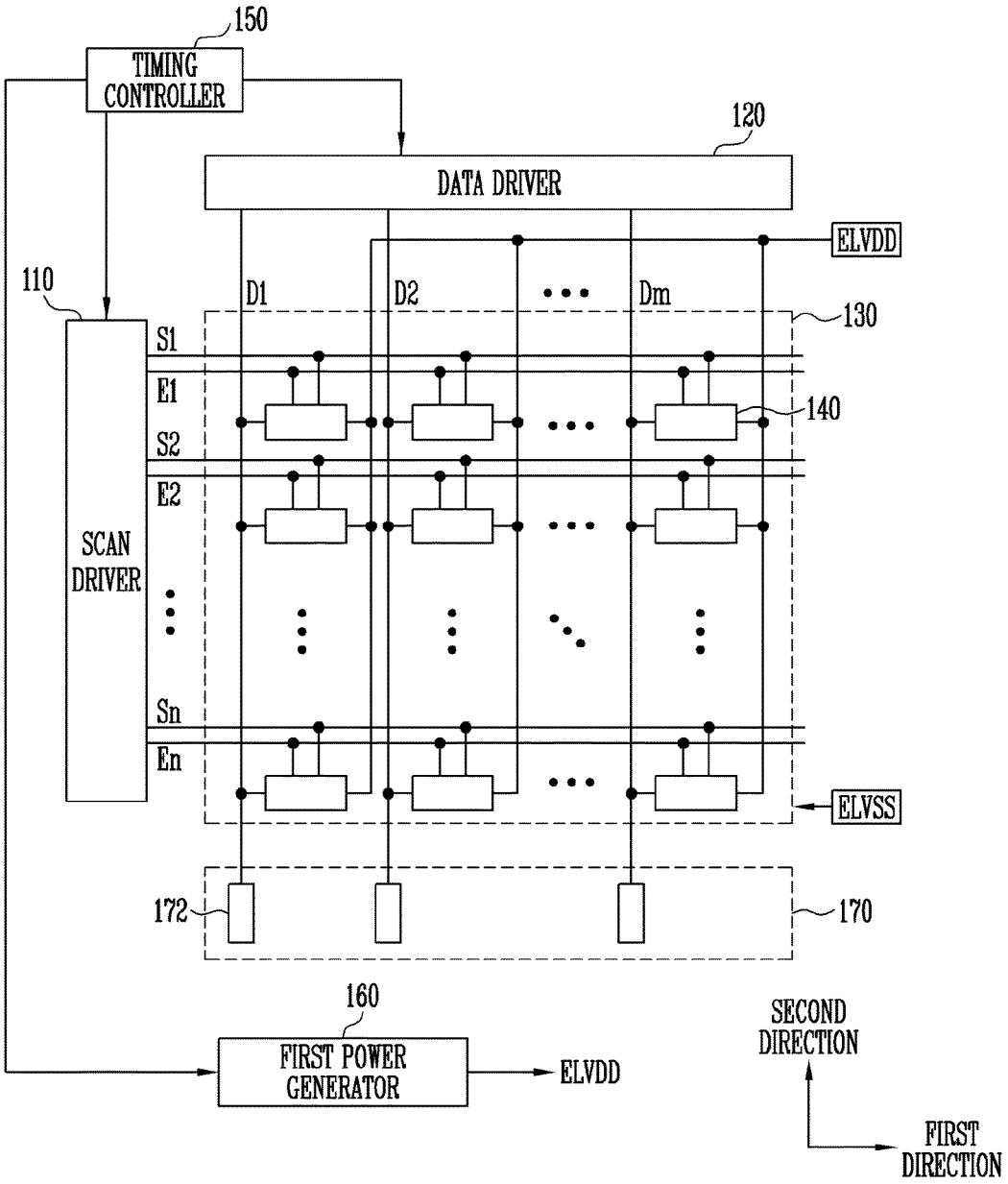
FIG. 1 is a view illustrating an organic light emitting display device according to an embodiment of the present invention.

Hereinafter, the embodiments of the present invention and other matters will be described in detail with reference to the accompanying drawings. However, because the embodiments of the present invention are implemented in various suitable forms within the scope of the claims, the embodiments described hereinafter are merely illustrative and are not limiting.

That is, the present invention is not limited to the embodiments disclosed hereinafter but may be implemented in various suitable forms. Also, in the drawings, like reference numerals refer to like elements (or components) although they are illustrated in different drawings.

It will be understood that, although the terms "first", "second", "third", etc., may be used herein to describe various elements, components, regions, layers, and/or sections, these elements, components, regions, layers and/or sections should not be limited by these terms. These terms are used to distinguish one element, component, region, layer or section from another element, component, region, layer or section. Thus, a first element, component, region, layer, or section discussed below could be termed a second element, component, region, layer, or section, without departing from the spirit and scope of the present invention.

The terminology used herein is for the purpose of describing particular embodiments and is not intended to be limiting of the present invention. As used herein, the singular forms "a" and "an" are intended to include the plural forms as well, unless the context clearly indicates otherwise. It will be further understood that the terms "comprise," "comprises," "comprising," "includes," "including," and "include," when used in this specification, specify the presence of stated features, integers, steps, operations, elements, and/or components, but do not preclude the presence or addition of one or more other features, integers, steps, operations, elements, components, and/or groups thereof.

As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the present invention refers to "one or more embodiments of the present invention." Also, the term "exemplary" is intended to refer to an example or illustration.

It will be understood that when an element or layer is referred to as being "on," "connected to," "coupled to," "connected with," "coupled with," or "adjacent to" another element or layer, it can be "directly on," "directly connected to," "directly coupled to," "directly connected with," "directly coupled with," or "directly adjacent to" the other element or layer, or one or more intervening elements or layers may be present. Further "connection," "connected," etc. may also refer to "electrical connection," "electrically connect," etc. depending on the context in which they are used as those skilled in the art would appreciate. When an element or layer is referred to as being "directly on," "directly connected to," "directly coupled to," "directly connected with," "directly coupled with," or "immediately adjacent to" another element or layer, there are no intervening elements or layers present.

As used herein, the term "substantially," "about," and similar terms are used as terms of approximation and not as terms of degree, and are intended to account for the inherent deviations in measured or calculated values that would be recognized by those of ordinary skill in the art.

A relevant device or component (or relevant devices or components) according to embodiments of the present invention described herein may be implemented utilizing any suitable hardware, firmware (e.g. an application-specific integrated circuit), software, or a suitable combination of software, firmware, and hardware. For example, the various components of the relevant device(s) may be formed on one integrated circuit (IC) chip or on separate IC chips. Further, the various components of the relevant device(s) may be implemented on a flexible printed circuit film, a tape carrier package (TCP), a printed circuit board (PCB), or formed on a same substrate as one or more circuits and/or other devices. Further, the various components of the relevant device(s) may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

As used herein, the terms "use," "using," and "used" may be considered synonymous with the terms "utilize," "utilizing," and "utilized," respectively.

FIG. 1 is a view illustrating an organic light emitting display device according to an embodiment of the present invention.

Referring to FIG. 1, the organic light emitting display device according to an embodiment of the present invention includes a display area 130 including pixels 140 positioned in regions divided (or defined) by scan lines S1 to Sn, light emission control lines E1 to En, and data lines D1 to Dm, a scan driver 110 for driving the scan lines S1 to Sn and the light emission control lines E1 to En, a data driver 120 for driving the data lines D1 to Dm, a first power generating unit (or first power generator) 160 for generating a first power ELVDD, a timing controller 150 for controlling the scan driver 110, the data driver 120, and the first power generator 160, and a pad unit 170 including pads 172 connected to the data lines D1 to Dm.

The scan lines S1 to Sn and the light emission control line E1 to En extend in a first direction and the data lines D1 to Dm extend in a second direction. Here, the first direction may be set as a horizontal direction and the second direction may be set as a vertical direction.

The timing controller 150 controls the scan driver 110, the data driver 120, and the first power generator 160 in response to signals supplied from the outside. Here, when a test signal is input from the outside, the timing controller 150 controls the scan driver 110, the data driver 120, and the first power generator 160 during an inspection period, and when a test signal is not input, the timing controller 150 controls the scan driver 110, the data driver 120, and the first power generator 160 during a driving period.

The data driver 120 supplies a data signal to the data lines D1 to Dm under the control of the timing controller 150. Here, the data driver 120 supplies an inspection data signal to the data lines D1 to Dm during the inspection period, and supplies a data signal corresponding to gray levels of the data lines D1 to Dm during the driving period. In addition, the inspection data signal may be selected as any one of the data signals that may be supplied from the data driver 120.

The first power generator 160 generates the first power ELVDD under the control of the timing controller 150, and supplies the generated first power ELVDD to the pixels 140. Here, the first power generator 160 supplies a first power ELVDD having a low voltage during the inspection period, and supplies a first power ELVDD having a high voltage during the driving period. The low voltage of the first power ELVDD is set as a voltage lower than that of the inspection data signal, and the high voltage of the first power ELVDD is set as a voltage at which the pixels 140 emit light.

The scan driver 110 supplies a scan signal to the scan lines S1 to Sn and supplies a light emission control signal to the light emission control lines E1 to En under the control of the timing controller 150. For example, the scan driver 110 may sequentially supply a scan signal to the scan lines S1 to Sn and sequentially supply a light emission control signal to the light emission control lines E1 to En during the inspection period and the driving period. Here, the light emission control signal may be set to have a width greater than that of the scan signal. For example, a light emission control signal supplied to an i-th light emission control line Ei (i is a natural number) may overlap a scan signal supplied to at least an (i−1)-th scan line (Si−1) and an i-th scan line Si.

In addition, the light emission control signal is set as a gate off voltage for turning off transistors included in the pixels 140, and the scan signal is set as a gate on voltage for turning on the transistors included in the pixels 140.

The display area 130 receives the first power ELVDD and a second power ELVSS and supplies the received first power ELVDD and the second power ELVSS to the pixels 140. During the driving period, each of the pixels 140 generates light having a brightness (e.g., a predetermined brightness), while controlling an amount of current flowing from the first power source ELVDD to the second power source ELVSS by way of an organic light emitting diode (OLED) in response to the data signal.

The pad unit 170 includes one or more pads 172 connected to at least one of the data lines D1 to Dm. For example, the pad unit 170 may include m pads 172 respectively connected to the data lines D1 to Dm. The pads 172 detect a defect, line byline, (e.g., detect a line with a defective pixel) according to an amount of current flowing to the data lines D1 to Dm during the inspection period.

The data driver 120 may be mounted on a panel in the form of an integrated circuit (IC). In this case, during the inspection period performed before the panel is released, the data driver 120 may not be installed on the panel. In response, the pads 172 may receive an inspection data signal by way of a probe during the inspection period, and supply the received inspection data signal to the data lines D1 to Dm.

Here, the probe, which is connected to an inspection device, may sense a current of the data lines D1 to Dm and supply an inspection data signal to the data lines D1 to Dm during the inspection period.

In addition, in FIG. 1, n scan lines (S1 to Sn) and light emission control lines E1 to En are illustrated, but the present invention is not limited thereto. In actuality, at least one dummy scan line and at least one light emission control line may be added corresponding to the structure of the pixels 140. Each of the pixels 140 may be additionally connected to a scan line and a light emission control line positioned in a horizontal line other than the horizontal line in which the pixel is located.

Also, in FIG. 1, it is illustrated that the scan driver 110 is connected to the scan lines S1 to Sn and the light emission control lines E1 to En, but the present invention is not limited thereto. For example, the light emission control lines E1 to En may be connected to a separate driver and receive a light emission control signal.

Figure 2:
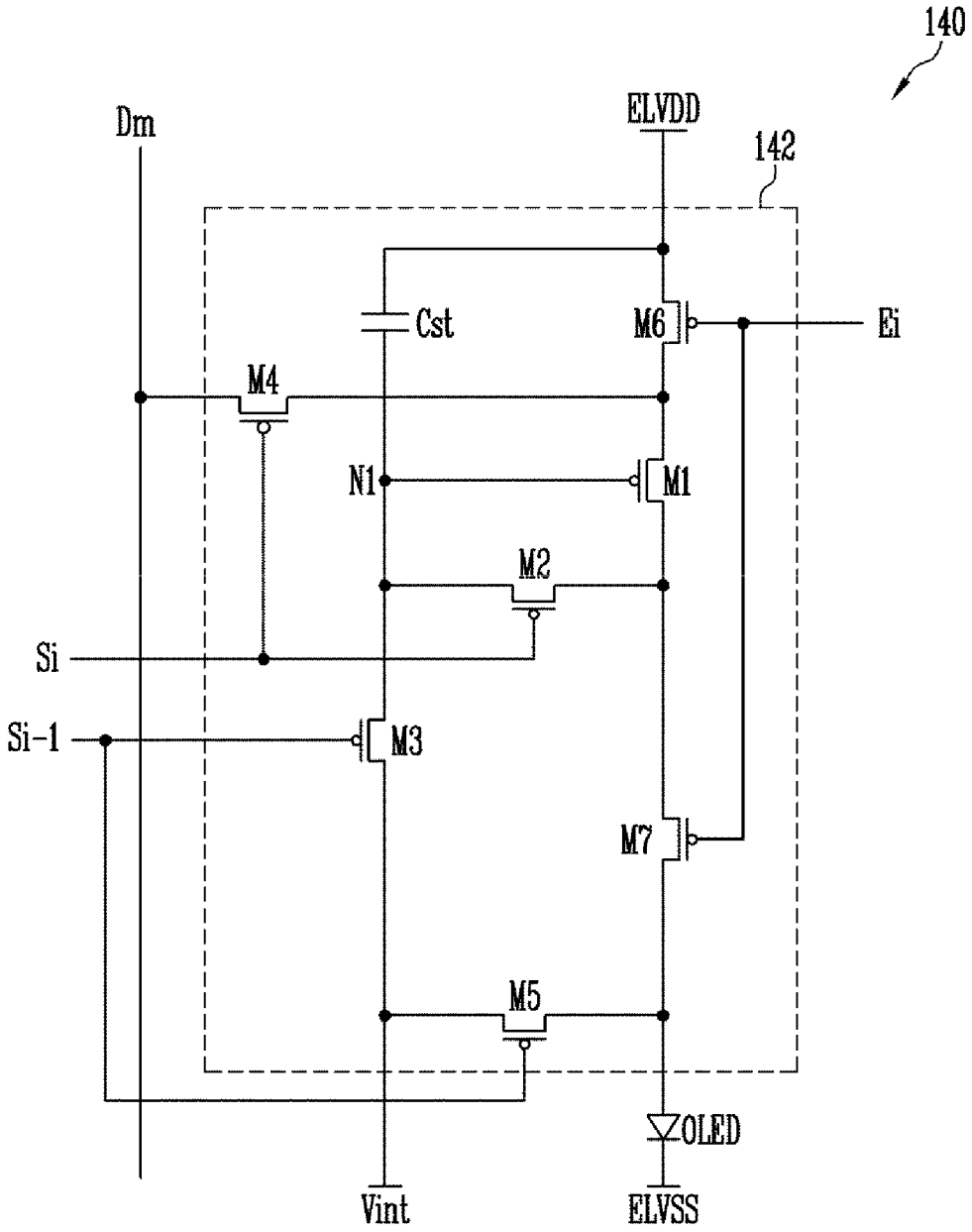
FIG. 2 is a circuit diagram illustrating an embodiment of a pixel illustrated in FIG. 1.

FIG. 2 is a circuit diagram illustrating an embodiment of a pixel illustrated in FIG. 1. In FIG. 2, a pixel connected to an mth data line Dm and positioned in an i-th horizontal line is illustrated for purposes of description.

Referring to FIG. 2, the pixel 140 according to an embodiment of the present invention includes an OLED, a data line Dm, and a pixel circuit 142 connected to scan lines Si−1 and Si and light emission control line Ei to control an amount of current supplied to the OLED.

An anode electrode of the OLED is connected to the pixel circuit 142, and a cathode electrode is connected to the second power source ELVSS. The OLED generates light having a brightness (e.g., a predetermined brightness) according to an amount of current supplied from the pixel circuit 142. To this end, the second power ELVSS is set to have a voltage lower than that of the first power ELVDD during the driving period.

The pixel circuit 142 controls an amount of current flowing from the first power source ELVDD to the second power source ELVSS by way of the OLED in response to a data signal.

A first electrode of a first transistor M1 is connected to the first power source ELVDD by way of a sixth transistor M6, and a second electrode of the first transistor M1 is connected to an anode electrode of the OLED by way of a seventh transistor M7. The first transistor M1 controls an amount of current flowing from the first power source ELVDD to the second power source ELVSS by way of the OLED according to a voltage of a first node N1 as a gate electrode of the first transistor M1.

A second transistor M2 is connected between the second electrode of the first transistor M1 and the first node N1. A gate electrode of the second transistor M2 is connected to the i-th scan line Si. The second transistor M2 is turned on when a scan signal is supplied to the i-th scan line Si, to electrically connect the second electrode of the first transistor M1 and the first node N1. Thus, when the second transistor M2 is turned on, the first transistor m1 is connected in a diode form.

A third transistor M3 is connected between the first node N1 and an initialization power source Vint. A gate electrode of the third transistor M3 is connected to the (i−1)-th scan line Si−1. The third transistor M3 is turned on when a scan signal is supplied to the (i−1)-th scan line and supplies a voltage of the initialization power Vint to the first node N1. Here, the initialization power Vint is set to have a voltage lower than that of the data signal.

A fourth transistor M4 is connected between the data line Dm and the first electrode of the first transistor M1. A gate electrode of the fourth transistor M4 is connected to the i-th scan line Si. The fourth transistor M4 is turned on when a scan signal is supplied to the i-th scan line Si, to electrically connect the data line Dm and the first electrode of the first transistor M1.

A fifth transistor M5 is connected between the initialization power source Vint and an anode electrode of the OLED. A gate electrode of the fifth transistor M5 is connected to the (i−1)-th scan line. The fifth transistor M5 is turned on when a scan signal is supplied to the (i−1)th scan line Si−1, to supply a voltage of the initialization power source Vint to the anode electrode of the OLED.

The fifth transistor M5 enhances black representation capability of the pixels 140. In some embodiments, when the fifth transistor M5 is turned on, a parasitic capacitor of the OLED is discharged. Then, when black brightness is implemented, the OLED does not emit light due to a leakage current from the first transistor M1, and thus, black representation capability may be enhanced.

In addition, in FIG. 2, it is illustrated that the fifth transistor M5 is connected to the (i−1)-th scan line Si−1, but the present invention is not limited thereto. For example, the fifth transistor M5 may receive any scan signal overlapping a light emission control signal supplied to the i-th light emitting control line Ei.

The sixth transistor M6 is connected between the first power source ELVDD and the first electrode of the first transistor M1. A gate electrode of the sixth transistor M6 is connected to the i-th light emission control line Ei. The sixth transistor M6 is turned off when a light emission control signal is supplied to the i-th light emission control line Ei, and is turned on in other cases.

A seventh transistor M7 is connected between the second electrode of the first transistor M1 and the anode electrode of the OLED. A gate electrode of the seventh transistor M7 is connected to the i-th light emission control line Ei. The seventh transistor M7 is turned off when a light emission control signal is supplied to the i-th light emission control line Ei, and turned on in other cases.

The storage capacitor Cst is connected between the first power source ELVDD and the first node N1. The storage capacitor Cst stores a voltage corresponding to a data signal.

A structure of the pixels 140 is not limited to the structure of FIG. 2. For example, the pixels 140 of embodiments of the present invention may be implemented in various suitable forms including a light emission control line.

Figure 3:
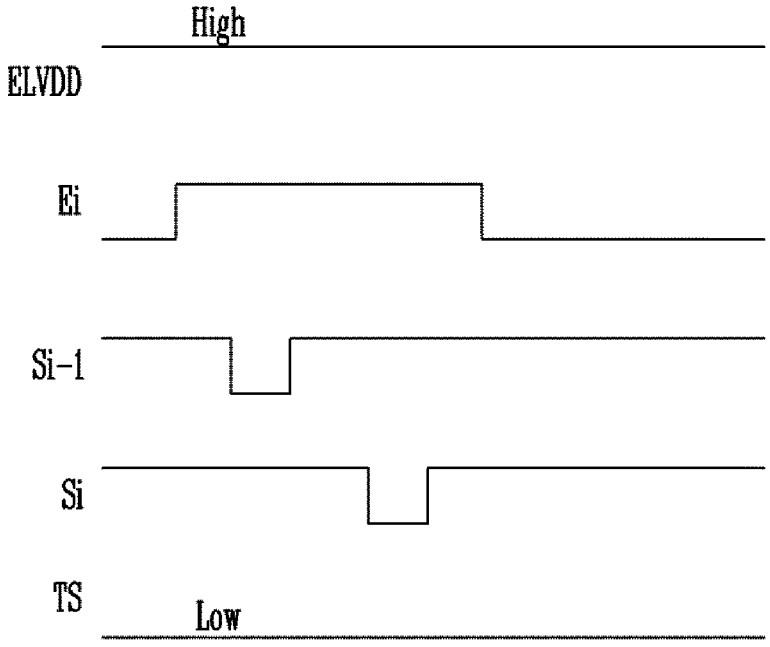
FIG. 3 is a view illustrating an embodiment of a driving waveform supplied during a driving period.

FIG. 3 is a view illustrating an embodiment of a driving waveform supplied during a driving period.

Referring to FIG. 3, during the driving period, the first power ELVDD is set to have a high voltage and a test signal TS is not supplied from the outside (That is, a test signal TS has a low voltage).

First, a light emission control signal is supplied to the i-th light emission control line Ei. When the light emission control signal is supplied to the i-th light emission control line Ei, the sixth transistor M6 and the seventh transistor M7 are turned off.

When the sixth transistor is turned off, the first power ELVDD and the first electrode of the first transistor M1 are electrically blocked (e.g., electrically disconnected or electrically isolated). When the seventh transistor M7 is turned off, the second electrode of the first transistor M1 and the anode electrode of the OLED are electrically blocked (e.g., electrically disconnected or electrically isolated). Thus, during a period in which a light emission control signal is supplied to the i-th light emission control line Ei, the pixel 140 is set to a non-light emission state.

Thereafter, a scan signal is supplied to the (i−1)-th scan line Si−1. When a scan signal is supplied to the (i−1)-th scan line Si−1, the third transistor M3 and the fifth transistor M5 are turned on. When the third transistor M3 is turned on, a voltage of the initialization power Vint is supplied to the first node N1. When the fifth transistor M5 is turned on, the voltage of the initialization power Vint is supplied to the anode electrode of the OLED, and thus, a parasitic capacitor of the OLED is discharged.

After the scan signal is supplied to the (i−1)-th scan line Si−1, a scan signal is supplied to the i-th scan line Si. When the scan signal is supplied to the i-th scan line Si, the second transistor M2 and the fourth transistor M4 are turned on.

When the second transistor M2 is turned on, the first node N1 and the second electrode of the first transistor M1 are electrically connected. That is, when the second transistor is turned on, the first transistor M1 is connected in a diode form.

When the fourth transistor M4 is turned on, a data signal from the data line Dm is supplied to the first electrode of the first transistor M1. Here, because the first node N1 has been initialized by the voltage of the initialization power Vint, the first transistor M1 is turned on. When the first transistor M1 is turned on, a voltage obtained by subtracting an absolute value threshold voltage of the first transistor M1 from the voltage of the data signal is supplied to the first node N1. Here, the storage capacitor Cst stores the data signal and a voltage corresponding to a threshold voltage of the first transistor M1.

After the data signal and the voltage corresponding to a threshold voltage of the first transistor M1 are stored in the storage capacitor Cst, supply of the light emission control signal to the i-th light emission control line Ei is stopped. When the supply of the light emission control signal to the i-th light emission control line Ei is stopped, the sixth transistor M6 and the seventh transistor M7 are turned on. When the sixth transistor M6 is turned on, the first power source ELVDD and the first electrode of the first transistor M1 are electrically connected. When the seventh transistor M7 is turned on, the second electrode of the first transistor M1 and the anode electrode of the OLED are electrically connected.

Here, in response to the voltage of the first node N1, the first transistor M1 controls an amount of current flowing from the first power source ELVDD to the second power source ELVSS by way of the OLED. Then, the OLED generates light having a brightness (e.g., a predetermined brightness) based on the amount of current supplied from the first transistor M1.

The pixels 140 generate light having brightness corresponding to the data signal, while repeating the aforementioned process.

Figure 4:
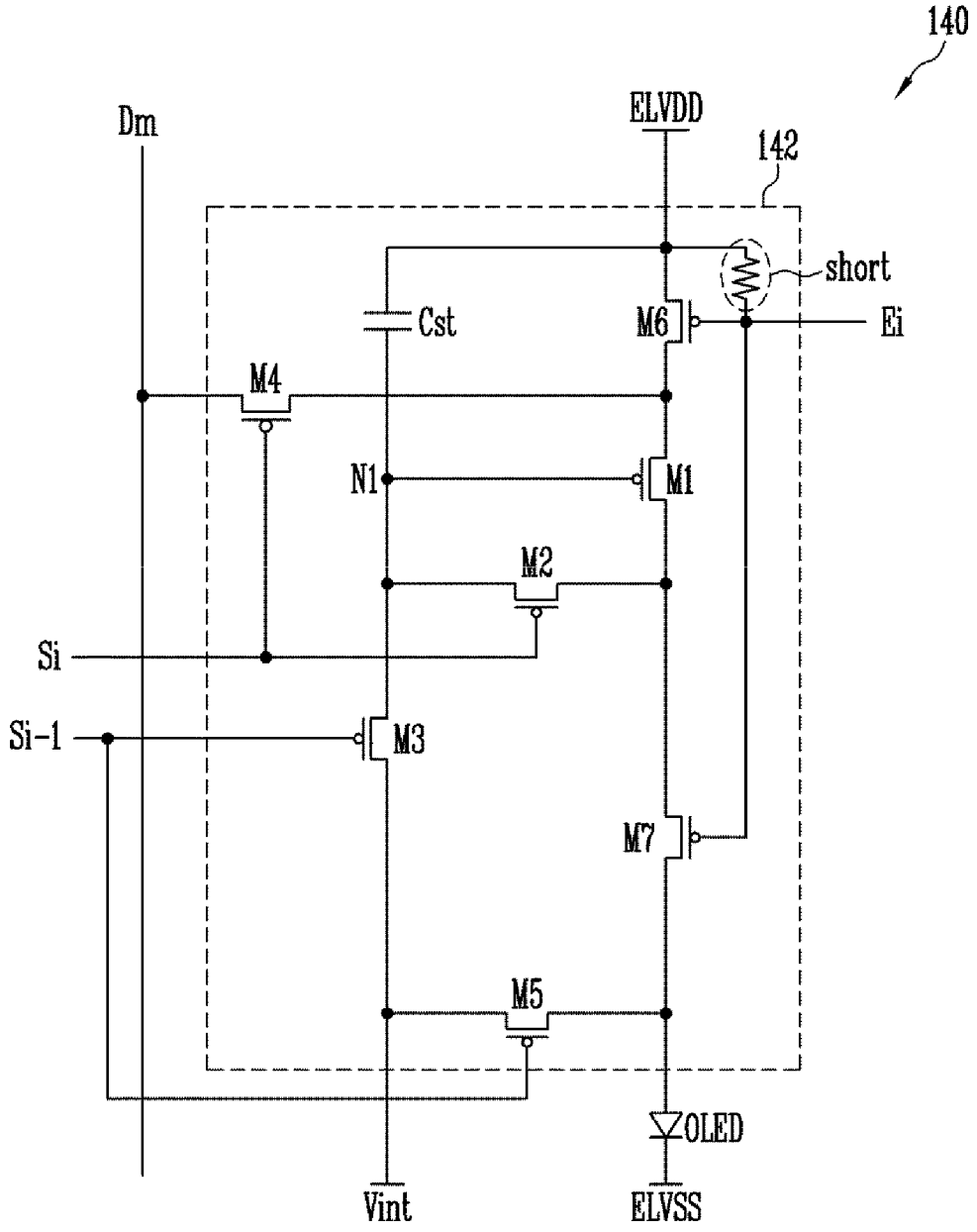
FIG. 4 is a view illustrating a defective pixel to which a first power source and a light emission control line are connected.

When the first power source ELVDD and the light emission control line Ei are shorted in a manufacturing process as illustrated in FIG. 4, an image cannot be normally displayed (i.e., correctly displayed). Thus, in embodiments of the present invention, a short between the first power source ELVDD and the light emission control lines E1 to En is detected using signal waves during an inspection process.

Figure 5:
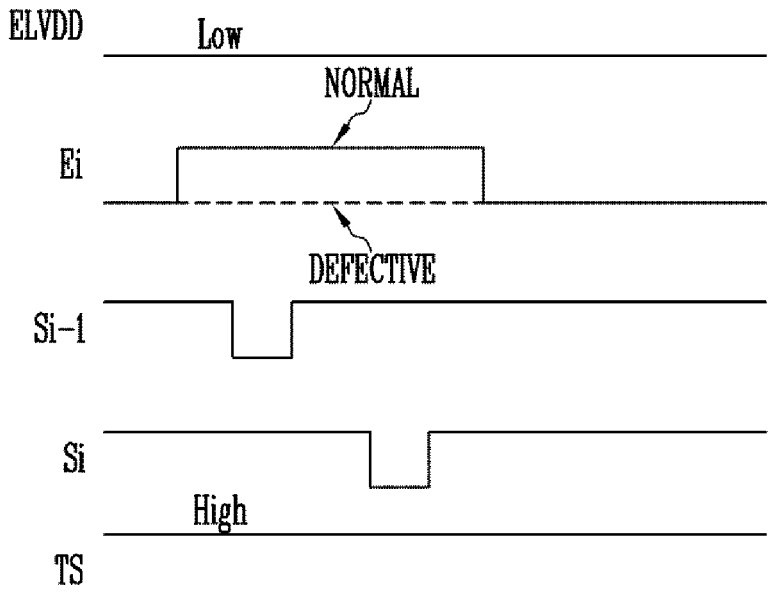
FIG. 5 is a view illustrating driving waveforms supplied during an inspection period.

FIG. 5 is a view illustrating driving waveforms supplied during an inspection period. The inspection process may be performed before a panel is released after the completion of the manufacturing process.

Referring to FIG. 5, a test signal TS is supplied from the outside during the inspection process. When the test signal TS is supplied, the timing controller 150 controls the first power generator 160 to set the first power ELVDD to have a low voltage.

During the inspection process, as illustrated in FIG. 3, the light emission control signal is supplied to the i-th light emission control line Ei, and a scan signal is sequentially supplied to the (i−1)th scan line Si−1 and the i-th scan line Si to overlap the i-th light emission control signal Ei.

The data driver 120 supplies an inspection data signal in synchronization with the scan signal. Here, the inspection data signal is to detect a defect, line by line, and any one of data signals that can be supplied from the data driver 120 may be set as the inspection data signal. In addition, the inspection data signal may be supplied from a probe connected to the pads 172 during an inspection period.

Figure 6A:
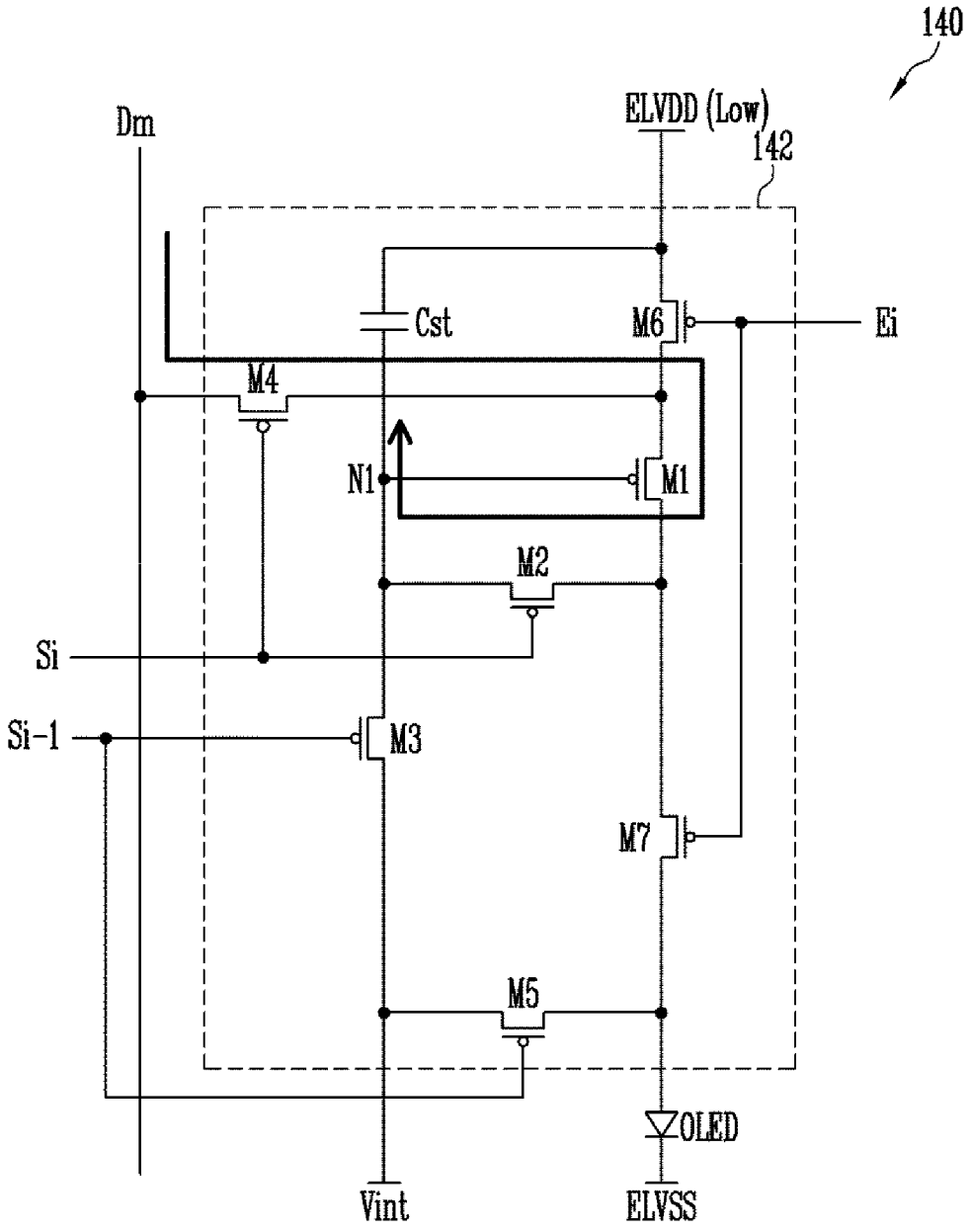
FIGS. 6A and 6B are views illustrating current flows of a normal pixel and a defective pixel during the inspection period of FIG. 5.

When a light emission control signal is supplied to the i-th light emission control line Ei, the sixth transistor M6 and the seventh transistor M7 are set to a turn-off state in a normal pixel 140. Thus, as illustrated in FIG. 6A, the inspection data signal from the data line Dm is supplied to the first node N1.

Figure 6B:
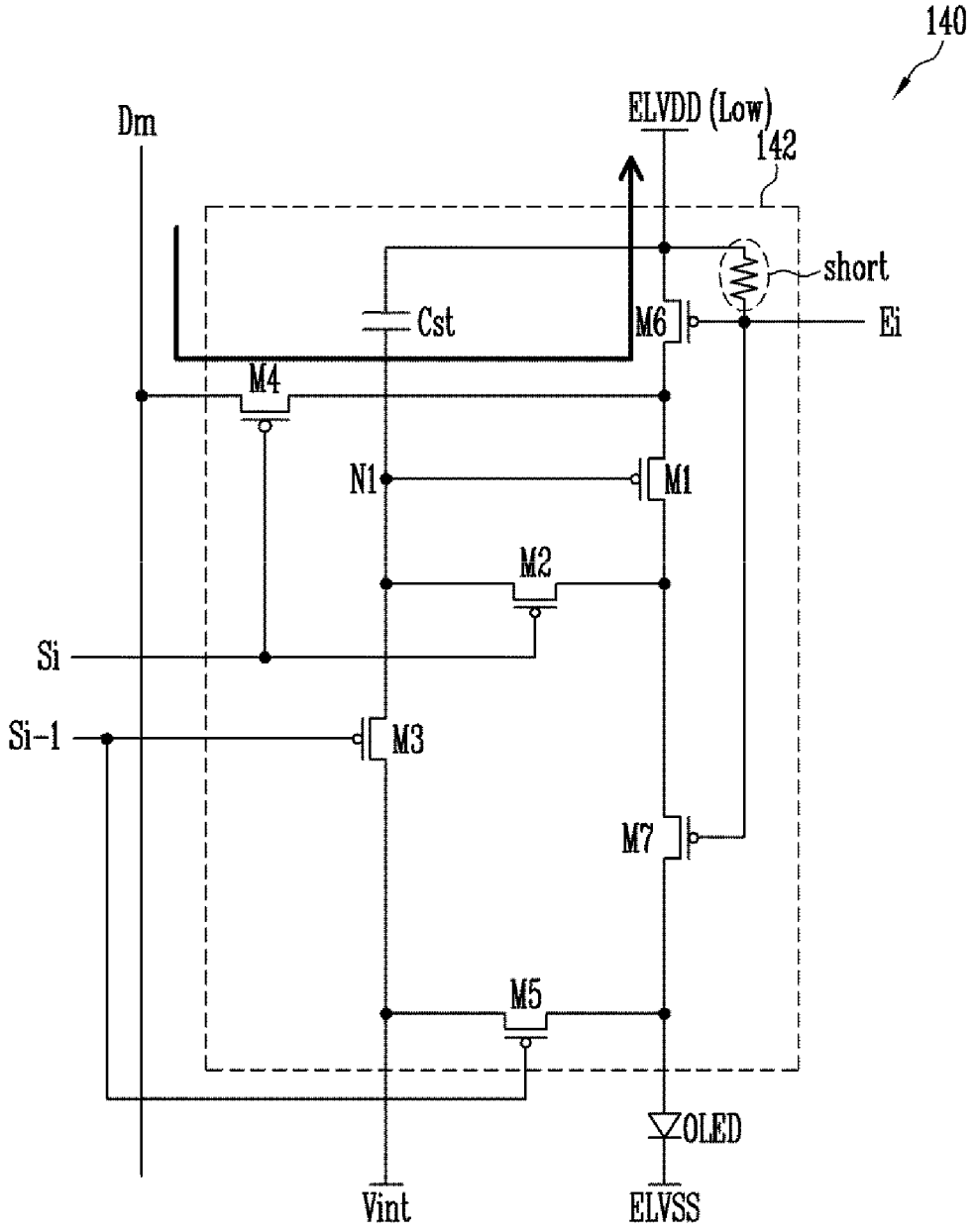

When the i-th light emission control line Ei is shorted with the first power ELVDD, the i-th light emission control line Ei is set to have a low voltage, and accordingly, the sixth transistor M6 and the seventh transistor M7 are turned on. Then, as illustrated in FIG. 6B, the inspection data signal from the data line Dm is supplied to the first power source ELVDD.

That is, when the light emission control signal is supplied to the light emission control lines E1 to En and the scan signal is sequentially supplied to the scan lines S1 to Sn during the inspection period, a defect may be detected, line by line.

In detail, during the inspection period, the pads 172 are connected to the probe of an inspection device. The probe connected to the pads 172 may detect a defect, line by line, according to an amount of current flowing to a data line (at least one of the data lines D1 to Dm).

Figure 7:
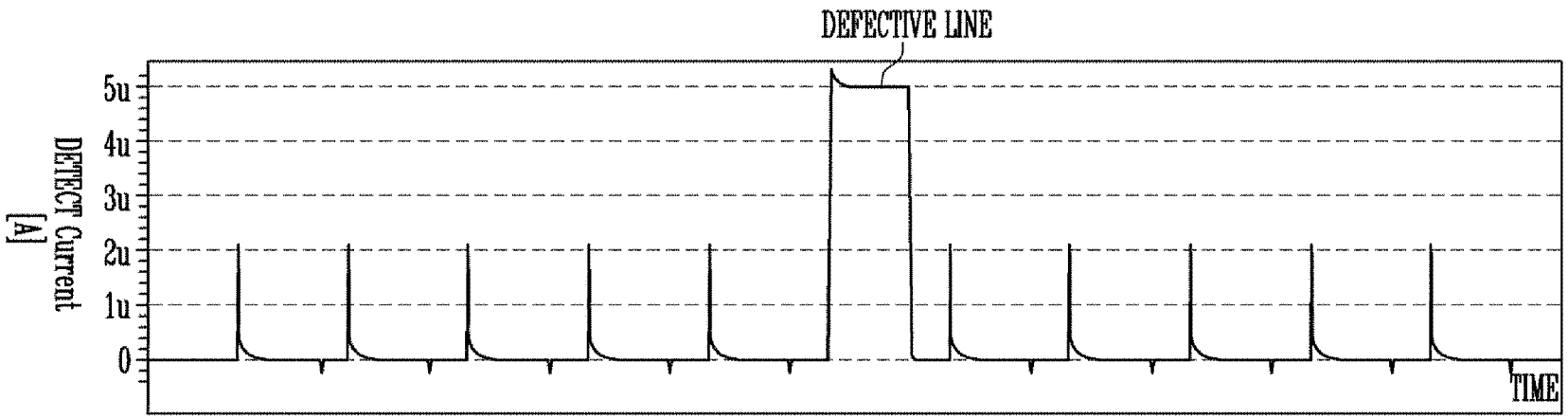
FIG. 7 is a view illustrating view illustrating a waveform of a current, line by line, during an inspection process.

In other words, when the i-th light emission control line Ei is shorted with the first power source ELVDD, a current is increased in the pixels 140 connected to the i-th light emission control line Ei as illustrated in FIG. 7. A defect of the pixels 140 is detected line by line, during the inspection period according to the increase in the current.

When a defect is detected, line byline, during the inspection period, the pixels 140 of a defective line are inspected using a camera. Here, a defective pixel may be repaired by blocking an electrical connection between the first power source ELVDD and the light emission control line Ei, thereby electrically isolating the first power source ELVDD from the light emission control line Ei, using a laser in the defective pixel 140.

As described above, in the present invention, a short between the first power source and the light emission control line may be detected using a waveform supplied during the inspection period, and thus, the inspection period may be considerably shortened. In other words, only when a defective line is detected, a defective pixel of the corresponding line is inspected using a camera, and thus, the inspection period of may be shortened, increasing production yield of large high resolution panels.

In addition, in the present invention, transistors are illustrated as PMOS transistors for the purposes of description, but the present invention is not limited thereto. In other words, the transistors may be formed as NMOS transistors.

Also, in the present invention, the OLED generates light having various suitable colors including red, green, and blue colors according to an amount of current supplied form the driving transistor, but the present invention is not limited thereto. For example, the OLED may generate white light according to an amount of current supplied from the driving transistor. In this case, a color image is implemented using a separate color filter, or the like.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, components, and/or elements described in connection with a particular embodiment may be used singly or in combination with features, characteristics, components, and/or elements described in connection with other embodiments unless otherwise indicated. Accordingly, it will be understood by those of skill in the art that various suitable changes in form and details may be made without departing from the spirit and scope of the present invention as set forth in the following claims and their equivalents.

What is claimed is:

1. An organic light emitting display device comprising pixels positioned in regions defined by scan lines and light emission control lines extending in a first direction and data lines extending in a second direction different from the first direction, the pixels being configured to control an amount of current flowing from a first power source to a second power source by way of organic light emitting diodes (OLEDs) in response to data signals, the organic light emitting display device comprising: a scan driver configured to sequentially supply scan signals to the scan lines and light emission control signals to the light emission control lines during an inspection period; a data driver configured to supply inspection data signals to the data lines in synchronization with the scan signals during the inspection period; a first power source supply configured to supply a first voltage as the first power source during the inspection period and to supply a second voltage as the first power source during another period, the second voltage being higher than the first voltage; and one or more pads connected to at least one of the data lines, and configured to enable detection of an improperly functioning light emission control transistor due to a short between a specific one of the light emission control lines and the first power source when the first voltage is supplied as the first power source during the inspection period, wherein a pixel connected to an i-th (i is a natural number) light emission control line, an i-th scan line, and a j-th (is a natural number) data line among the pixels comprises: an organic light emitting diode; a first transistor configured to control the amount of current flowing from the first power source to the second power source by way of the organic light emitting diode according to a voltage of a gate electrode of the first transistor; a second transistor connected between a second electrode of the first transistor and the gate electrode of the first transistor, the second transistor having a gate electrode connected to the i-th scan line, a third transistor connected between an initialization power source having a voltage that is lower than that of the data signals and the gate electrode of the first transistor, and configured to apply a voltage of the initialization power source to the gate electrode of the first transistor while the light emission control signal of a hi h level is applied to the pixel, the third transistor having a gate electrode connected to an (i−1)-th scan line; a fourth transistor connected between the j-th data line and a first electrode of the first transistor, the fourth transistor having a gate electrode connected to the i-th scan line; and a light emission control transistor on a path of the current flowing from the first power source to the second power source by way of the organic light emitting diode, the light emission control transistor having a gate electrode connected to the i-th light emission control line.

2. The organic light emitting display device of claim 1, wherein the short between the specific one of the light emission control lines and the first power source is detected using an amount of current applied to the one or more pads during the inspection period.

3. The organic light emitting display device of claim 1, wherein the first voltage of the first power source is set to a voltage that is lower than that of the inspection data signals, and wherein the second voltage is set to a voltage at which the pixels emit light.

4. A method of repairing an organic light emitting display device, the method comprising: supplying scan signals to scan lines and light emission control signals to light emission control lines, line by line; supplying inspection data signals to data lines in synchronization with the scan signals; detecting a defect, line by line, according to an amount of current supplied to at least one pad connected to the data lines to determine that an i-th line (i is a natural number) is defective; inspecting a short between an i-th one of the light emission control lines and a first power source, the first power source supplying a current in each of pixels positioned in the i-th line; and repairing one or more of the pixels that are determined to be shorted, wherein the display device comprises one or more pads connected to at least one of the data lines, and configured to enable detection of an improperly functioning light emission control transistor due to a short between a specific one of the light emission control lines and the first power source when a first voltage is supplied as the first power source during an inspection period, wherein a pixel connected to the i-th one of the light emission control lines, an i-th scan line, and a j-th (j is a natural number) data line among the pixels comprises: an organic light emitting diode; a first transistor configured to control the amount of current flowing from the first power source to a second power source by way of the organic light emitting diode according to a voltage of a gate electrode of the first transistor; a second transistor connected between a second electrode of the first transistor and the gate electrode of the first transistor, the second transistor having a gate electrode connected to the i-th scan line, a third transistor connected between an initialization power source having a voltage that is lower than that of the data signals and the gate electrode of the first transistor, and configured to apply a voltage of the initialization power source to the gate electrode of the first transistor while the light emission control signal of a high level is applied to the pixel, the third transistor having a gate electrode connected to an (i−1)-th scan line; a fourth transistor connected between the j-th data line and a first electrode of the first transistor, the fourth transistor having a gate electrode connected to the i-th scan line; and a light emission control transistor on a path of the current flowing from the first power source to the second power source by way of the organic light emitting diode, the light emission control transistor having a gate electrode connected to the i-th light emission control line.

5. The method of claim 4, wherein the inspection data signals are supplied from a data driver.

6. The method of claim 4, wherein the at least one pad is connected to each of the data lines, and wherein the inspection data signals are supplied from a probe connected to the at least one pad.

7. The method of claim 4, wherein, in the inspecting the short, the short between the first power source and the i-th one of the light emission control lines, in the one or more of the pixels that are determined to be shorted, is detected using a camera.

8. The method of claim 4, wherein, in the repairing of the one or more of the pixels that are determined to be shorted, the i-th one of the light emission control lines and the first power source are electrically isolated using a laser in the one or more of the pixels that are determined to be shorted.

9. The method of claim 4, wherein the first power source is set to have a voltage value that is lower than that of the inspection data signals.

* * * * *